United States Patent [19]

Baird et al.

[11] Patent Number: 4,708,579

[45] Date of Patent: Nov. 24, 1987

[54] HYDRAULICALLY OR MANUALLY ACTUATED IMPLEMENT COUPLER FOR FRONT END LOADERS

[75] Inventors: James R. Baird, Akron; Steve Kabay, Novelty, both of Ohio

[73] Assignee: JRB Company, Inc., Akron, Ohio

[21] Appl. No.: 635,131

[22] Filed: Jul. 27, 1984

[51] Int. Cl.[4] ..... E02F 3/40

[52] U.S. Cl. ..... 414/723; 172/272

[58] Field of Search ..... 414/723; 172/272; 37/117.5

[56] References Cited

U.S. PATENT DOCUMENTS

| | | | |
|---|---|---|---|
| 3,204,793 | 9/1965 | Lane | 414/723 X |
| 3,243,066 | 3/1966 | Gardner et al. | 414/723 X |
| 3,417,886 | 12/1968 | Stuart | 414/723 |
| 3,985,249 | 10/1976 | Aker et al. | 414/723 |
| 4,030,624 | 6/1977 | Matthews | 414/723 |
| 4,488,850 | 12/1984 | Wernimont | 414/723 |

FOREIGN PATENT DOCUMENTS

| | | | |
|---|---|---|---|
| 1279491 | 11/1961 | France | 414/723 |
| 58-98532 | 6/1983 | Japan | 414/723 |

*Primary Examiner*—Leslie J. Paperner

*Attorney, Agent, or Firm*—Oldham, Oldham & Weber Co.

[57] ABSTRACT

A quick coupler for front end loader implements having a male master pivotally connected by pins to the upper and lower extendable arms of a front end loader and a female coupler attached to any of a variety of buckets, plows, scoops, forks, or other implements. The female member consists of a pair of upper hooks and lower protruding eyes engageable by the male member having a pair of upper bridge pins and lower, channeled slots. Upper engagement is made between bridge pins and hooks and lower engagement by insertion of the protruding eyes into the slotted channels. Coupling is secured or released by extension or retraction of hydraulically or manually actuated pins through the slotted holes and protruding eyes.

5 Claims, 4 Drawing Figures

HYDRAULICALLY OR MANUALLY ACTUATED IMPLEMENT COUPLER FOR FRONT END LOADERS

TECHNICAL FIELD

This invention relates to quick couplers for front end loader implements.

BACKGROUND ART

Front end loaders are powered vehicles running on wheels or tracks having hydraulically operated upper and lower pairs of arms extending from the front of the vehicle. The arms operate in tandem in a linked parallelogram arrangement and perform useful work by means of attached implements such as a bucket, scoop, plow, fork, or the like. It is often desirable to change implements and quick couplers have been developed for this purpose. Such coupler systems use a male master mounted on the upper and lower arms of a front end loader together with female coupler attachments affixed to an implement.

The problem with prior systems has been that they are bulky and they extend the effective attachment points of the implement beyond the original front end loader arm attachment points, thereby adversely affecting the loader's performance. Front end loaders are designed for a certain performance taking best advantage of the loader's weight and power. Prior art in this field shows couplers being designed about the implements. The present design is based upon maintaining vehicle performance. Best machine performance is maintained by a coupler design which links an implement to the arms of the loader at or near the original linkage points. Thus, performance specifications are not altered or reduced by extension of the original linkage points due to the intervening bulk of the coupler. Stability, tipping load, usable reach, break-out force, and dump height all are reduced by extending the loader's lever arms by a bulky coupler, but not so with the invention herein.

DISCLOSURE OF INVENTION

Thus it is a general object of the present invention to provide an improved quick coupler for front end loader implements that attaches an implement to front end loader arms at points near the original linkage points provided in machine and implement.

Another object of the invention is to provide a hydraulically or manually actuated front end loader implement coupler that maintains loader efficiency by implement attachment as close to original end pin connections as possible.

A further object of the invention is to provide a front end loader implement coupler that is sturdy, safe, and reliable for handling heavy loads over a long period of time.

Yet another object of the invention is to provide a quick coupler for front end loader implements that is made from conventional materials and can be produced at reasonable costs.

The foregoing and other objects and advantages of the invention which will be made more apparent as the specification proceeds are achieved by a coupler for front end loader having upper and lower arms, comprising: a male master portion adapted for receipt by the arms of the front end loader; and a female coupler portion adapted for receipt by an implement for use with the front end loader.

BRIEF DESCRIPTION OF DRAWINGS

Reference now is made to the accompanying drawings wherein.

When referring to elements shown in the drawings and referred to in the specification, corresponding numerals are used to facilitate comparison therebetween.

BEST MODE FOR CARRYING OUT THE INVENTION

Figure 2:
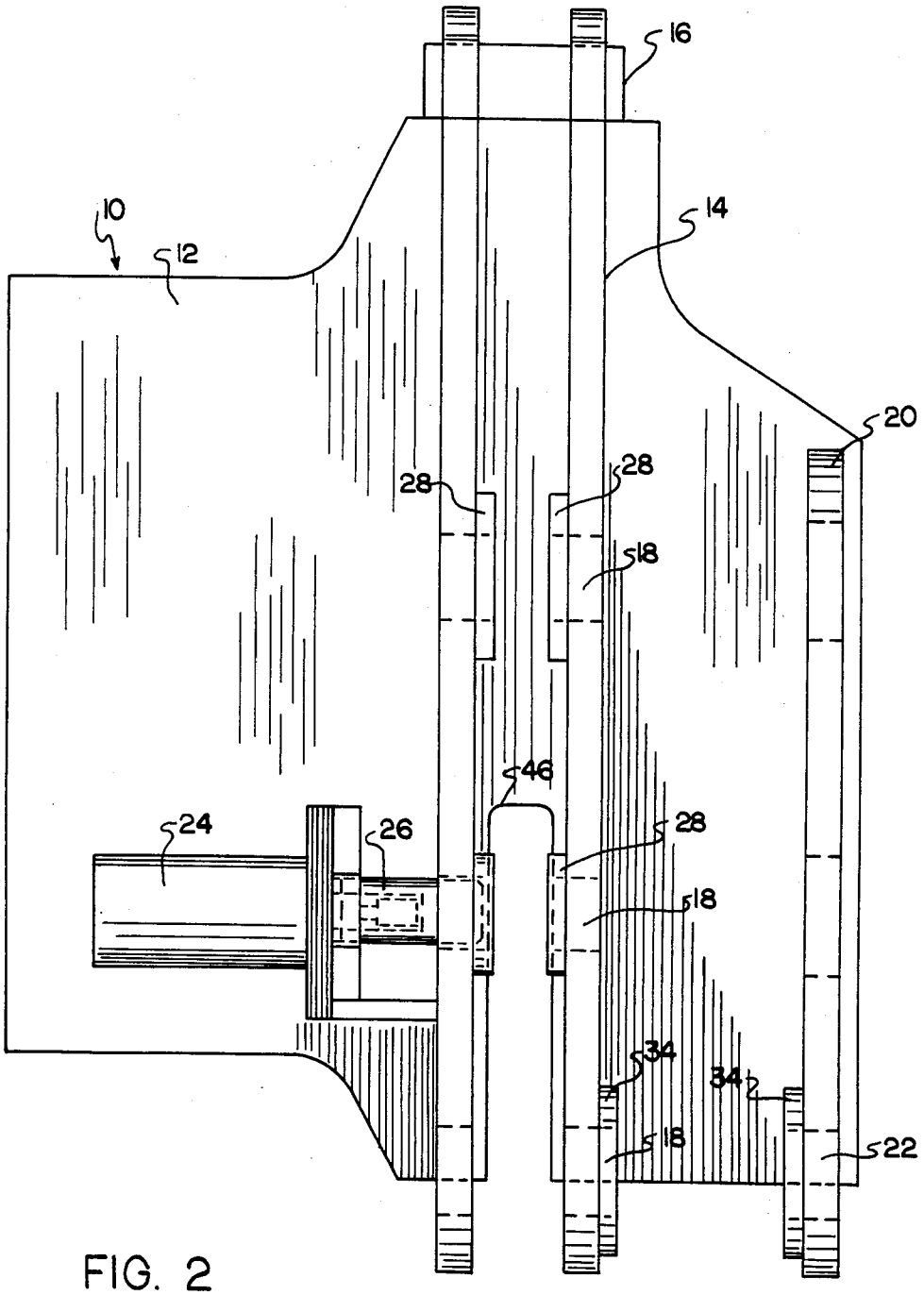
FIG. 2 is a rear elevation of the right half of the male master coupler portion.

Reference now is particularly made to the details of the construction shown in the drawings. A male master coupler portion is depicted generally as numeral 10. It is comprised of an angularly contoured face plate 12 having a vertical channel on the rear side formed by channel plates 14 welded thereon or otherwise suitably affixed. It should be noted that the structure shown in FIG. 2 is for the right half of the male master coupler portion 10 and is an exact mirror image of the left half, not shown. The channel formed by channel plates 14 extends above the face plate at its upper end and contains a bridge pin 16 suitably affixed such as through a pair of aligned holes at such extended upper end of the channel formed by channel plates 14. Three pairs of aligned holes 18 are provided through the channel plates 14 at positions below the bridge pin. A reinforcing plate 20 is welded or otherwise suitably affixed to the face plate in parallel alignment with channel plates 14, said reinforcing plate 20 being equipped with a hole 22 at its lower end in alignment with the lower set of aligned holes 18. A hydraulic cylinder 24, actuated by hydraulic pressure through hydraulic lines (not shown) from the front end loader and controlled from the cab by the operator, is attached to the face plate in a suitable manner. Each hydraulic cylinder 24 contains an extendable locking pin 26 aligned with the middle pair of holes 18 through channel plates 14. Suitable bushings 28 are provided on the inner walls of the channel plates 14 in alignment with said lower pair of middle holes to facilitate a passageway for extendable locking pin 26.

Figure 1:
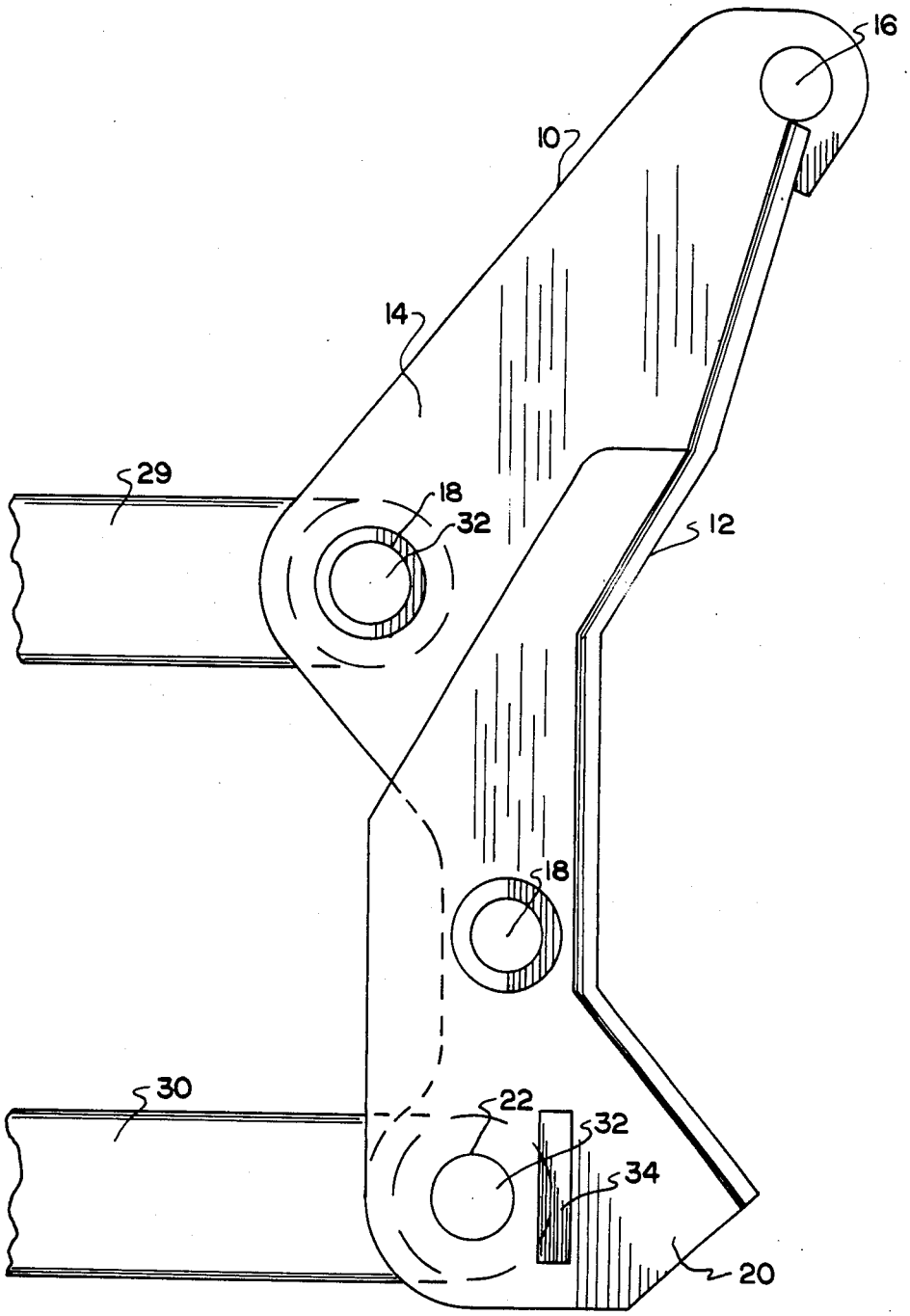
FIG. 1 is a side view of the male master coupler portion attached to the loading ends of an upper and lower pair of front end loader arms (remainder of arms and loader not shown)

As best shown in FIG. 1, the male master coupler portion is attached to an upper pair of front end loader arms 29 at the upper set of holes 18 through channel plates 14, also equipped with bushings 28, and said male master coupler portion is pinned to a lower pair of front end loader arms 30 by means of a hinge pin 32. It should be noted that hinge pin 32, upon attachment to the lower pair of arms of the front end loader, extends through the passageway formed by the aligned holes at the lower end of channel plates 14 and reinforcing plate 20. Said hinge pin 32 is equipped with a flat portion and is secured from rotation by a pair of retention blocks 34.

Figure 3:
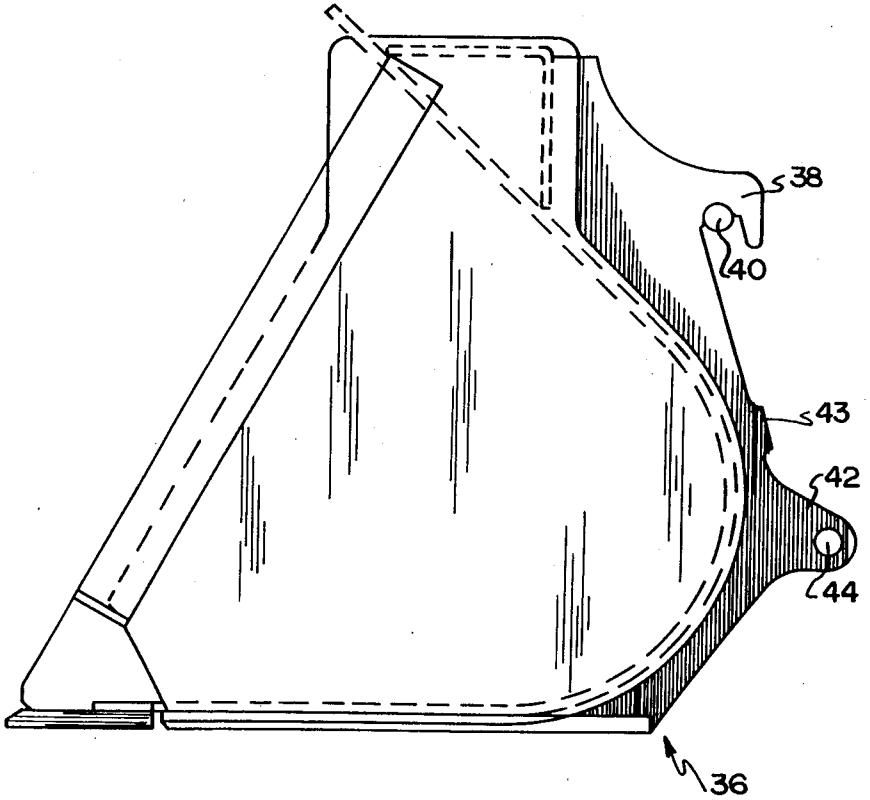
FIG. 3 is a side elevation of a bucket showing the female coupler portion.
Figure 3A:
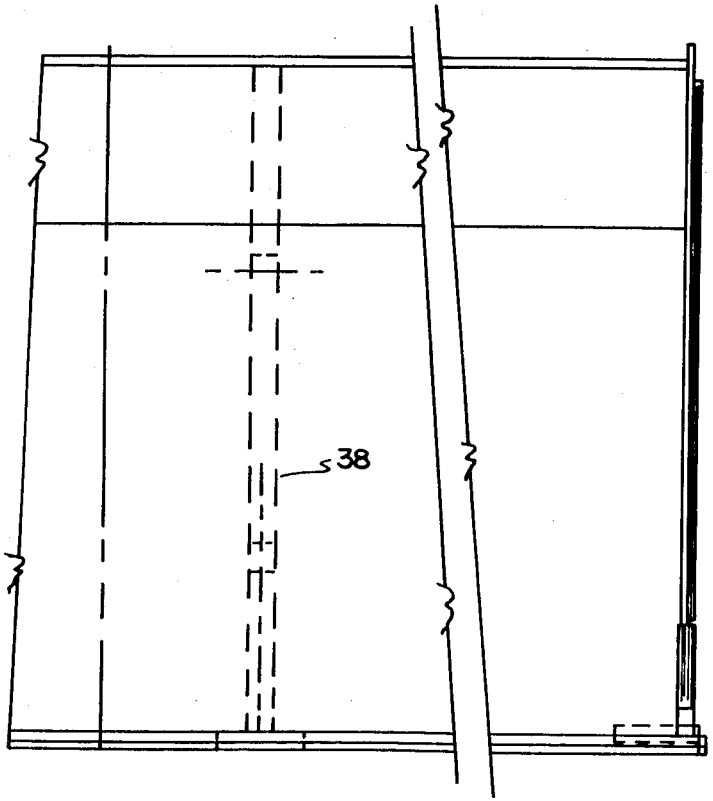
FIG. 3A is a sectional front perspective view of the bucket of FIG. 3.

The female coupler portion for an implement is shown generally in FIG. 3 by numeral 36. In this case, a bucket is provided with the female coupler consisting of a pair of plates welded or otherwise secured to the back of the implement, and each having an upper pair of hooks 38 having an inside diameter 40 matching the outside diameter of bridge pins 16 for receiving said bridge pins during coupling. A lower pair of protruding eyes 42 contain holes 44 of a diameter suitable to receive locking pins 26 and extend from each of the pair of plates of the female coupler. Coupling of the device is accomplished by upward entry of bridge pins 16 into the inside diameter 40 of hooks 38 with protruding eyes 42 extending through a slot 46 in the face plate of the male master coupling portion as best shown in FIG. 2. The hole 44 forming the eye portion of the protruding eyes 42 is positioned to align with the passageway of locking pin 26 defined by the middle set of aligned holes 18. Upon alignment, locking pins can be extended by hydraulic or manual actuation to complete locking of the implement and to secure attachment. The contoured face 12 of the male master coupling portion is generally angularly configured to fit an attachment face 36 on an implement.

It should be noted that, by the unique mating arrangement between the male master coupler portion 10 and the female coupler portion 36 through the slots 46 and the eyes 42, the lower pair of loader arms 30 connect to the male master via hinge pins 32 within two (2) inches of the original point of connection to the bucket or implement without the coupling system. In other words, the unique design of the coupler of the invention maintains the bottom hinge point within two inches of the original design. This provides for the ability to nearly duplicate original equipment specifications as to stability, tipping load, usable reach, break-out force, and dump height.

It should also be noted that each of the plates of the female coupler has a support face or protrusion 43 extending therefrom for contacting engagement with the face plate 12 of the male master. In such a manner, forceful supporting engagement between the male master portion 10 and the female coupler 36 is via the bridge pins 16 and the support face 43, with no weight bearing force on the locking pins 26. This provides for quick engagement and disengagement between the male master portion 10 and the female coupler 36 without the risk of damage to the locking pins 26.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be had to the appended claims.

What is claimed is:

1. A coupler for a front end loader having upper and lower arms, comprising:

a male master portion adapted for receipt by the arms of the front end loader; and a female coupler portion adapted for receipt by an implement for use with the front end loader;

wherein said male master portion comprises:

a contoured face plate;

a pair of channel plates affixed to the back of said face plate, said channel plates having first and second pairs of aligned holes passing therethrough for receiving and maintaining the upper and lower arms of the front end loader by pinned connection, said channel plates further including a bridged pin extending thereacross at top ends thereof, said face plate having a slot therein in alignment with a channel formed between said channel plates; wherein said female coupler portion comprises:

a plate having a hook at an upper portion thereof for receipt by said bridged pin, and an eye protruding from a bottom portion thereof adapted to pass through said slot; and a support face extending from said plate of said female coupler portion between said hook and said eye adapted for making contacting engagement with said contoured face plate when said bridged pin is received by said hook and said extendable pin is received by said eye.

2. The coupler according to claim 1 wherein said channel plates have a third set of aligned holes passing therethrough in juxtaposition to said slot.

3. The coupler according to claim 2 which further includes an extendable pin in communication between a third set of aligned holes and across said channel at said slot.

4. A coupler for a front end loader having upper and lower arms, comprising:

a male master portion having a contoured face plate with a slot therein, said slot being between two vertical parallel plates forming a channel therebetween, said plates having a bridges pin extending across a top portion thereof, and an extendable pin selectively operable to extend across said channel in juxtaposition to said slot;

a female coupler portion comprising a plate having a hook at an upper section thereof adapted for receipt by said bridged pin, and a protruding eye at a lower section thereof adapted for receipt with said slot and in engagement with said extendable pin; and wherein said plate of said female coupler portion further includes a support surface protruding from said plate between said hook and said eye for supporting contacting engagement with said contoured face of said male master portion.

5. The coupler according to claim 4 wherein said parallel plates include pairs of aligned holes passing therethrough for pinned interconnection with the upper and lower arms.

* * * * *